US008074477B1

(12) United States Patent
Weiche

(10) Patent No.: US 8,074,477 B1
(45) Date of Patent: Dec. 13, 2011

(54) FIREARM STORAGE DEVICE

(76) Inventor: Christopher R. Weiche, Alma, AR (US)

( * ) Notice: Subject to any disclaimer, the term of this patent is extended or adjusted under 35 U.S.C. 154(b) by 430 days.

(21) Appl. No.: 12/156,177

(22) Filed: May 29, 2008

(51) Int. Cl.
*E05B 73/00* (2006.01)

(52) U.S. Cl. ..... 70/14; 70/58; 70/62; 70/63; 70/161; 5/503.1; 5/658; 211/64

(58) Field of Classification Search ..... 70/63, 57, 70/58–62, 159–162; 109/50–52; 206/317; 224/912, 913; 248/176.1, 311.3, 551–553; 5/503.1, 658; 211/4, 7, 64; 42/70.01, 70.11
See application file for complete search history.

(56) References Cited

U.S. PATENT DOCUMENTS 1,718,878 A * 6/1929 Raquette ..... 220/3.4
1,964,035 A * 6/1934 Cross ..... 224/410
3,294,247 A * 12/1966 Norrington ..... 211/64
3,482,810 A * 12/1969 Bailey ..... 248/311.2
3,796,358 A * 3/1974 Grubb ..... 224/255
3,958,694 A * 5/1976 Pritz ..... 211/4
4,018,339 A * 4/1977 Pritz ..... 211/8
4,129,909 A 12/1978 Riehl ..... 5/317
4,461,442 A 7/1984 Keenan ..... 248/205.1
4,466,148 A 8/1984 Jones ..... 5/503
4,483,501 A 11/1984 Eddy ..... 248/205.1
4,521,930 A 6/1985 Henson ..... 5/508
4,788,838 A 12/1988 Cislo ..... 70/63
4,869,449 A 9/1989 Goodman ..... 248/205.1
4,890,466 A 1/1990 Cislo ..... 70/63
5,009,088 A 4/1991 Cislo ..... 70/63
5,056,342 A 10/1991 Prinz ..... 70/63
5,111,545 A 5/1992 Krozal ..... 5/503.1
5,168,994 A * 12/1992 Beletsky et al. ..... 206/317
5,188,328 A * 2/1993 Thompson ..... 248/309.2
5,317,888 A 6/1994 Towns ..... 70/63
D358,284 S 5/1995 Hill ..... D6/503
5,683,021 A * 11/1997 Setina ..... 224/311
5,691,396 A 11/1997 Takemura et al. ..... 522/62
5,701,770 A 12/1997 Cook et al. ..... 70/63
5,713,650 A 2/1998 King et al. ..... 312/265.4
5,732,914 A 3/1998 Flinn ..... 248/201
5,738,020 A * 4/1998 Correia ..... 109/51
5,881,584 A * 3/1999 Brunoski et al. ..... 70/68
5,896,605 A 4/1999 Branman ..... 5/716
5,901,589 A 5/1999 Cordero ..... 70/63
5,916,087 A 6/1999 Owens ..... 5/503.1
5,987,941 A 11/1999 Zocco ..... 70/63
6,082,272 A 7/2000 Adrain ..... 109/51
6,085,671 A * 7/2000 Kerr et al. ..... 109/51
6,405,861 B1 * 6/2002 Siler et al. ..... 206/317
6,523,374 B1 2/2003 Owens ..... 70/63

(Continued)

*Primary Examiner* — Lloyd Gall
(74) *Attorney, Agent, or Firm* — Keisling & Pieper, PLC; Stephen D. Schrantz

(57) ABSTRACT

The present invention relates generally to a firearm storage device adapted to store at least one object, including but not limited to a firearm. A housing of the present invention attaches to a support arm located upon a lower support surface. The housing includes a mounting shell wall and a locking shell wall that pivots away from the mounting shell wall to allow access to the contents of the housing. Inside the housing, a support finger engages the interior of the barrel of a firearm to orient the firearm in a manner that provides a user with access to the grip of the firearm. The housing also locks to prevent unauthorized users from accessing the contents of the housing. The housing also releases from the support arm to allow a user to utilize the housing as a secure device to transport an object.

3 Claims, 5 Drawing Sheets

U.S. PATENT DOCUMENTS 6,570,501 B2 * 5/2003 Bushnell et al. ..... 340/542
6,684,432 B2 2/2004 Owens, Jr. ..... 5/694
6,843,081 B1 * 1/2005 Painter ..... 70/63
7,028,621 B2 * 4/2006 Mercier ..... 109/56
7,159,711 B1 * 1/2007 Gardner ..... 206/317
7,434,427 B1 * 10/2008 Miresmaili ..... 70/63
2002/0066704 A1 * 6/2002 Poppe ..... 211/26
2007/0277713 A1 * 12/2007 Miresmaili ..... 109/51

* cited by examiner

FIREARM STORAGE DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates generally to a firearm storage device for securely storing and carrying a firearm. The present invention adds additional safety to the user by preventing unauthorized access to the firearm. In addition, the present invention allows easy access to authorized users of the firearm.

In the event an intruder enters the home of a firearm owner, the known firearm storage devices prevent an authorized user from easily accessing the firearm. The known firearm devices that prevented such easy access of the firearm rendered the firearm nearly useless during emergency situations when a firearm is needed quickly.

Firearm owners desire to safely and securely store their firearms. Firearm owner also desire to have their firearms loaded and readily accessible in the event of an intruder, especially at night.

II. Description of the Known Art

The Known Art

U.S. Pat. No. 6,684,432 ("the '432 patent") issued to Owens, Jr. on Feb. 3, 2004 teaches a bed mattress system including a bed mattress apparatus, a security container having an interior portion, means for accessing the interior portion of the security container, and a moveable flap operable for covering the means for accessing the interior portion of the security container. The security container taught by the '432 patent is operable for holding items disposed within the interior portion of the security container. The '432 patent teaches the security container 82 being preferably disposed within the bed mattress 80 such that the opening 88 of the security container 82 is substantially adjacent to an edge 90 of the bed mattress 80. Optionally, the security container 82 may include a plurality of openings 88 and may be disposed within the bed mattress 80 such that the plurality of openings 88 of the security container 82 are substantially adjacent to a plurality of edges 90 of the bed mattress 80. The security container 82 is disposed within the bed mattress 80 such that an individual sleeping or sitting on top of the bed mattress 80 may readily access the opening 88 of the security container 82 and the contents thereof. The security container 82 is also disposed within the bed mattress 80 such that the security container 82 provides edge support for an individual sleeping or sitting on top of the bed mattress 80.

U.S. Pat. No. 6,292,960 ("the '960 patent") issued to Bowling teaches a concealed safe for concealment of firearms and other valuables therein, the safe being sized and shaped to replace a bed box-springs. The safe taught by the '960 patent includes a top surface to support a mattress of a bed, a bottom surface to engage a supporting floor, a plurality of exterior side walls and corners being sized and shaped to support a mattress bed. The safe taught by the '960 patent includes an internal storage cavity bounded by interior walls a lower floor. The safe taught by the '960 patent includes side wall openings through at least one of the exterior side walls and through respective interior walls, into which one or more drawers can be inserted into the storage cavity. Each drawer taught by the '960 patent is lockable and concealed from view when inserted into the safe in a concealed position, and each drawer is extendable outwards from the storage cavity into an exposed position. A rolling means supports each drawer and allows each drawer to be moved along at least one pair of roller tracks positioned on an interior wall within the storage cavity, providing a user ease of opening and loading each drawer in the exposed position, and allowing closing each drawer to the concealed position into the concealed safe that is hidden under a mattress and appears as a bed box-springs.

U.S. Pat. No. 7,178,370 ("the '370 patent") issued to Engel on Feb. 20, 2007 teaches a gun safe that includes a computer system and is readily located and used by a home owner under the darkness of night. The safe taught by the '370 patent permits a loaded ready-to-use firearm to be stored and accessed safely and quickly. The safe door opens silently and uses motive power provided by gravity. The safe door will open only when the safe correlates biometric data of an individual with biometric data stored in the memory of the computer system used to operate the safe. The '370 patent teaches that the safe is mounted in one of a group consisting of the floor, the wall, the ceiling.

U.S. Pat. No. 5,317,888 ("the '888 patent") issued to Towns on Jun. 7, 1994 teaches a device for attachment to a bed frame for the receipt of articles therein having a receptacle with a closed end and an open end, a door fastened to said open end, a lock attached to the door so as to fix a position of the door with respect to the receptacle, a clamp attached to a forward end of the receptacle so as to affix the receptacle to the bed frame, and a support connected to a back end of the receptacle so as to support the receptacle above a surface. The clamp taught by the '888 patent is a mounting bracket affixed by a bolt to the receptacle. An area between the receptacle and the mounting bracket of the invention taught by the '888 patent engages corresponding surfaces of the bed frame. The receptacle taught by the '888 patent has a top surface, a base, a pair of sides, and a pair of ends extending upwardly relative to the base. The support of the '888 patent is an extendible leg fastened to a rear end of the receptacle so as to support the receptacle in a generally level condition.

U.S. Pat. No. 5,111,545 ("the '545 patent") issued to Krozal on May 12, 1992 teaches a holster mount having a bracket with a horizontal plate placed between a box springs and a bed frame. A vertical plate of the invention taught by the '545 patent extends upward between the springs and the bed frame. A support plate of the invention taught by the '545 patent extends upward from the vertical plate, offset by a spacer away from the box springs. In addition, the '545 patent teaches a specially designed holster that includes a flap and a pair of snaps that pass through a pair of holes in the support plate to connect the holster to the bracket. The snaps taught by the '545 patent are spaced far enough apart to allow the holster to be mounted on a typical belt.

U.S. Pat. No. 4,461,442 ("the '442 patent") issued to Keenan on Jul. 24, 1984 teaches a pistol holster bracket for supporting a pistol in its holster on the side of a bed. The holster bracket taught by the '442 patent has a member which slides between the mattress and a box spring and an upstanding vertical member with an angled element for receiving the belt loop of a holster. The angled element of the '442 patent has an angle of sufficient degree to tilt the holster to a position where the pistol is easily accessible by a person lying in bed.

U.S. Pat. No. 4,483,501 ("the '501 patent") issued to Eddy on Nov. 20, 1984 teaches an elongated first stiff panel that provides and includes a second panel supported from one end thereof by an integral "living hinge". The second panel taught by the '501 patent has a plurality of bores formed therethrough arranged in a circular pattern wherein each bore has a corresponding diametrically opposite bore in the pattern of bores. A bar overlies one side of the second pattern and includes opposite end bores formed therethrough registrable with diametrically opposite bores formed in the second panel and fasteners are removably secured through the bores in the opposite ends of the bar and corresponding diametrically opposite bores formed in the panel. The fasteners of the invention taught by the '501 patent are removable and the bar may be angularly displaced and resecured to the second panel in adjusted angular position relative thereto about an axis disposed normal to the second panel and passing through the center of the aforementioned circular pattern. At least the center portion of the bar is spaced from the opposing side face of the second panel in order that a portion of the support loop of a gun holster may be passed between the bar midportion and the opposing second panel. The first panel is equipped with longitudinally and transversely spaced bores or apertures through which attaching fasteners may be secured in order to mount the first panel against a suitable support surface. The '501 patent teaches that the first panel 12 may be inserted between the box spring 42 and mattress 44 at one end of a bed and that the handgun 32 within the holster 30 supported from the holder 10 is supported in "ready" position.

U.S. Pat. No. 5,056,342 ("the '342 patent") issued to Prinz on Oct. 15, 1991 teaches a security box or a container assembly designed to be secured to the undersurface of a table, counter, bed frame, or like structure so as to extend beneath the undersurface in a substantially out-of-sight location and specifically adapted to hold a handgun or other applicable weapon, valuables or medication in a readily accessible location for easy removal once a cover of the container is opened. To mount the container under a bed, a mounting structure taught by the '342 patent is removably attached to the bed frame so as to support the container in the preferred out-of-sight location beneath the bed in a somewhat cantilevered fashion. The '342 patent also teaches that mounting to other surfaces, such as under a table or counter top can be achieved by securing the top of the container to the mounting surface in such a manner as to be out of the general line of sight.

U.S. Pat. No. 5,009,088 ("the '088 patent") issued to Cislo on Apr. 23, 1991 teaches an apparatus to lock a handgun within a compartment while the compartment is readily lockable to a stationary object using a clip. The compartment taught by the '088 patent is only accessible by authorized persons to unlock a latch to open the compartment. The latch can be lighted to allow entry at night. The apparatus also serves to carry the handgun and can subsequently be used to so secure the handgun at another location.

U.S. Pat. No. 4,521,930 ("the '930 patent") issued to Henson on Jun. 11, 1985 teaches a pistol mounting bracket for mounting a pistol holster of the type having a pistol receiving pouch and a belt loop attached to the pouch for securing the holster to the body of a wearer onto a bed. The mounting bracket of the invention taught by the '930 patent has a support arm which is adapted to be fitted under the bed mattress and a holding arm connected to the support arm and depending therefrom in a plane generally perpendicular to the plane of the support arm. The holding arm of the invention taught by the '930 patent has a connecting end fixed to the support arm and an opposite flange end adapted to be slidingly received within the belt loop of the pistol holster.

U.S. Pat. No. 4,466,148 ("the '148 patent") issued to Jones on Aug. 21, 1984 teaches a pair of brackets positioned on opposite sides or opposite ends of a mattress and interconnected by a strap or the like which is disposed between the mattress and box spring or other mattress support; at least one of the opposing brackets being fitted with a holster support bar which is vertically adjustable utilizing a plurality of apertures in the bracket and conventional means of attachment such as bolts and nuts or other fasteners. The holster support bar taught by the '148 patent fits through the belt loop of a belt-type holster or within the clip of a clip-on holster which is held in position adjacent to the mattress.

Nothing in the known art provides a firearm storage device that securely stores a firearm to prevent unauthorized access of the firearm while allowing easy access of the firearm to authorized users.

In light of the known art, a need still exists for a firearm storage device that allows easy access to the firearm in emergency situations. In addition, a need continues to exist for a firearm storage device that provides the benefit of easy access while preventing unauthorized users from accessing the firearm.

Thus, it may be seen that these known patents are very limited in their teaching and utilization, and an improved firearm storage device is needed to overcome these limitations.

SUMMARY OF THE INVENTION

The present invention provides a firearm storage device that allows a user to securely store a firearm while providing easy access to the firearm. The present invention provides a support arm to be placed between an upper support surface and a lower support surface. In one embodiment of the present invention, the support arm is designed to be placed between the box springs and mattress of a user's bed. The present invention also provides a housing attached to the support arm. The housing of the present invention stores at least one object such as a firearm in one embodiment of the present invention. Thus, the present invention allows the user to safely store a firearm at a convenient location accessible to the user at night when intruders may be present.

In addition, the present invention secures the firearm to prevent unauthorized users from accessing the firearm. To safely secure the firearm, the present invention provides a locking mechanism to prevent unauthorized users from accessing the firearm. In one embodiment of the present invention, the locking mechanism is a biometric lock. By using a biometric lock, the present invention allows authorized users to access the firearm without requiring the user to enter a code or search for a key. Thus, the biometric lock eliminates much of the difficulties of the known firearm storage devices. Other known locking devices such as combination locks, keyed locks, electric locks including keypads, magnetic locks, as padlocks as well as other known locks, may be used in the present invention to prevent unauthorized access of the firearm.

In one embodiment of the present invention, the housing is releasably attached to the support arm to enable the user to detach the housing from the support arm and transport the housing to another location. Thus, the present invention also serves as a secured carrying device for a firearm. In addition, the releasable nature of the housing allows for the present invention to be more compact to simplify both shipping and storage of the present invention. The releasably attached housing enables a user to implement a number of support arms in different locations. Thus, the user can detach the housing from one location and move the housing to another location where the user has previously placed a support arm without rearranging the support arms.

To allow easy access to the firearm stored within the present invention, the housing of the present invention includes a mounting shell wall and a locking shell wall. The locking shell wall is hingeably attached to mounting shell wall. In one embodiment, locking shell wall is spring loaded such that locking shell wall is biased to an open position. Biasing of the locking shell wall to the open position permits the user easy and quick access to the contents of the housing.

To improve the placement of the firearm within the housing, the support finger of the present invention is designed to secure the firearm. In one embodiment of the present invention, the support finger is adapted to be fit inside of the barrel of the firearm. The firearm is placed upon the support finger such that the support finger enters the barrel of the firearm. The support finger orients the firearm such that the grip of the firearm is directed toward the user when the locking shell wall is opened.

It is an object of the present invention to securely store a firearm to prevent unauthorized use of the firearm.

It is a further object of the present invention to store a firearm so that children cannot access the firearm.

It is a further object of the present invention to prevent accidental firings of the firearm.

It is a further object of the present invention to increase the safety of storing a firearm.

It is a further object of the present invention to allow easy access to a firearm stored within the present invention.

It is a further object of the present invention to allow adjustment of the firearm safety device to allow the housing of the present invention to be stored at multiple levels.

It is a further object of the present invention to enable a user to safely and quickly remove the firearm from the present invention.

It is a further object of the present invention to be fully customized to allow the user to select the position in which the present invention stores the firearm.

It is a further object of the present invention to provide a housing that is releasably attached to enable a user to remove the housing and safely store the firearm during transport of the firearm.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

The present invention provides a user with a firearm storage device allowing a user to safely store a firearm. The present invention also enables a user to easily access the firearm. The present invention provides a support arm to be placed between an upper support surface and a lower support surface. In one embodiment of the present invention, the support arm is designed to be placed between the box springs and mattress of a user's bed. The present invention also provides a housing attached to the support arm. The housing of the present invention stores at least one object such as a firearm in one embodiment of the present invention. Thus, the present invention allows the user to safely store a firearm at a convenient location accessible to the user at night when intruders may be present. In one embodiment, the firearm storage device 100 is constructed of metal such as steel. In another embodiment, the firearm storage device 100 is constructed of plastic or another durable material.

Figure 1:
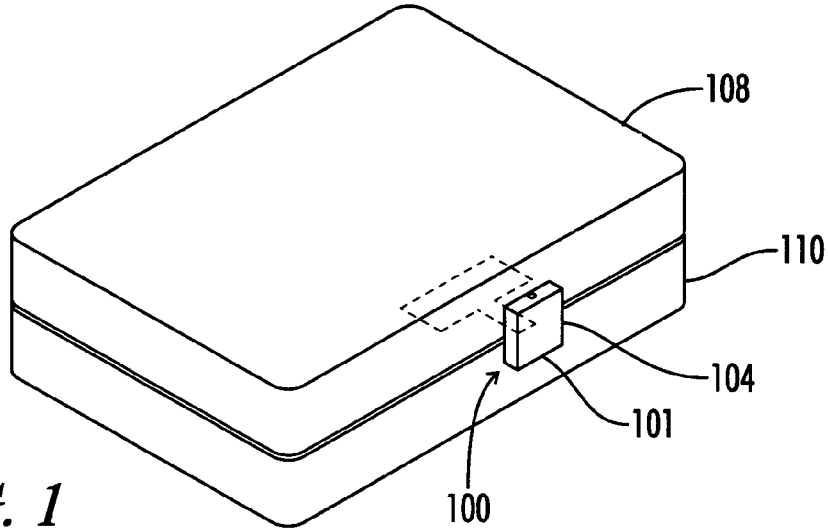
FIG. 1 is an environmental view of the firearm storage device of the present invention.

FIG. 1 shows the firearm storage device 100 located near the bed thus allowing a user to securely store objects. Support arm 114 of firearm storage device 100 found between upper support surface 108 and lower support surface 110 supports housing 101. In one embodiment of the present invention, the firearm storage device 100 conveniently fits between the mattress and the box springs to provide a user access to the contents of housing 101 at or near the bed. Thus, the present invention provides additional security to a user who can store a firearm near where the user will be sleeping so that the user will be prepared for intruders. Support arm 114 of firearm storage device 100 also conveniently fits between upper support surface 108 and lower support surface 110 other than a mattress and box springs.

As will be described later, housing 101 securely stores an object such as a firearm so that a user may conveniently access the firearm stored in housing 101 in emergency situations. Housing 101 also securely stores a firearm to prevent unauthorized users from accessing the firearm stored in housing 101. The present invention utilizes a locking element 103 such as combination locks, keyed locks, electric locks including keypads, magnetic locks, padlocks, as well as other known locks to eliminate unauthorized access. In one embodiment of the present invention, locking element 103 is a biometric lock that enables the user to access the contents of housing 101 without fumbling with a key or other locking code. Thus, the biometric lock allows the user to quickly access the firearm in emergency situations.

To increase the speed with which the user can access the contents of housing 101, locking shell wall 104 is pivotally attached to mounting shell wall 102. The pivotal attachment of locking shell wall 104 to mounting shell wall 102 enables locking shell wall 104 to pivot in relation to mounting shell wall 102. Locking shell wall 104 pivots away from mounting shell wall 102 to open and close to provide access to the contents of housing 101. In one embodiment of the present invention, housing 101 stores a firearm 112. Support finger 106 secures the firearm 112 to enable the user to easily grasp firearm 112.

Figure 2:
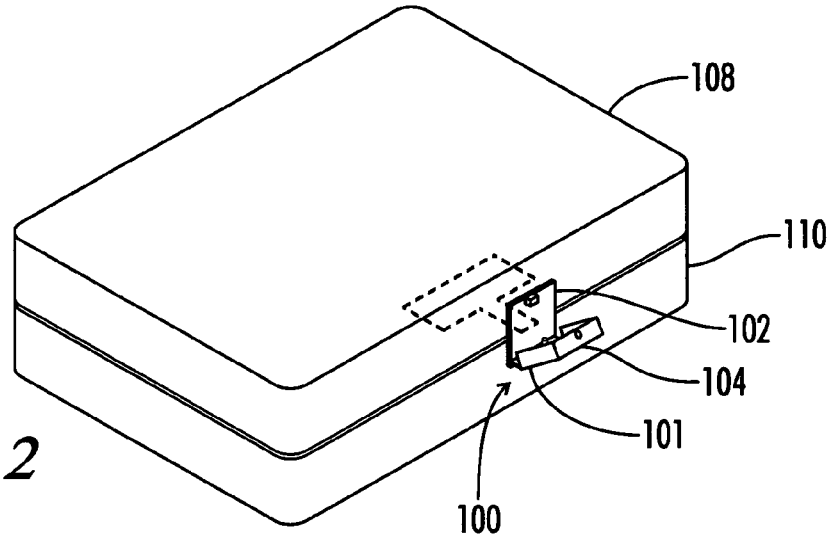
FIG. 2 is another environmental view thereof.

Referring to FIG. 2, housing 101 opens and closes to provide access to the contents of housing 101. More specifically, locking shell wall 104 pivots from mounting shell wall 102. Locking shell wall 104 biased from mounting shell wall 102 reveals the contents of housing 101, firearm 112. Locking shell wall 104 is biased to the open position to provide the user with access to the contents of housing 101. As shown in FIG. 2, locking shell wall 104 pivots to provide the user with unobstructed access to the contents of housing 101.

Figure 3:
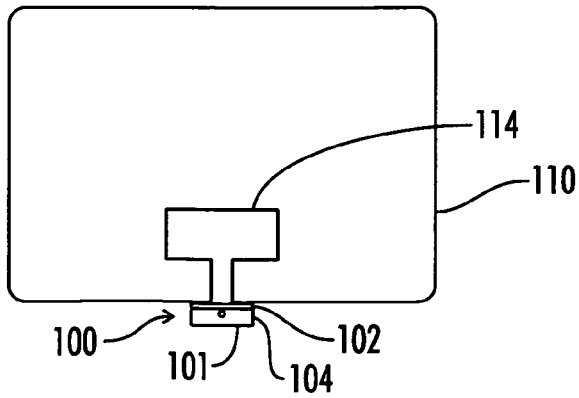
FIG. 3 is a top plan environmental view thereof.

FIG. 3 shows an environmental view of the firearm storage device 100 from the top down. Lower support surface 110 provides the support to maintain the position of support arm 114 and firearm storage device 100. Support arm 114 attaches to housing 101 at mounting shell wall 102 to support housing 101. In one embodiment of the present invention, traction pads attach to support arm 114 to increase the traction of support arm 114 on upper mounting surface 108 and lower mounting surface 110. Traction pads attached to support arm 114 also reduce damage that may occur to upper mounting surface 108 and lower mounting surface 110. The weight of support arm 114 can be increased such that upper mounting surface 108 is not required to stabilize the firearm storage device 100.

Figure 4:
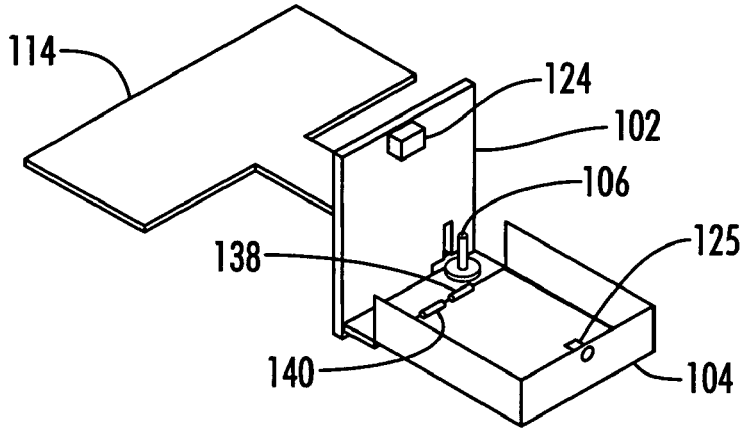
FIG. 4 is a perspective view thereof.
Figure 5:
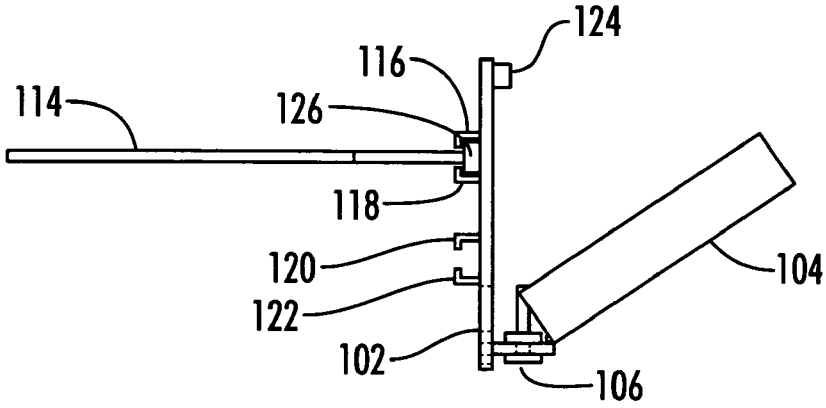
FIG. 5 is a left side elevational view thereof.
Figure 6:
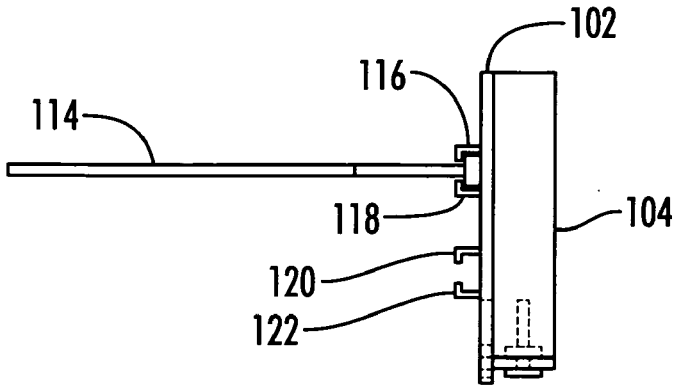
FIG. 6 is a another left side elevational view thereof.

FIG. 4 shows a perspective view of the present invention. As shown in FIG. 4, housing 101 includes mounting shell wall 102 and locking shell wall 104. Locking shell wall 104 pivots from a closed position as seen in FIG. 6 to an open position as seen in FIG. 5. In one embodiment of the present invention, locking shell wall 104 is pivotally attached to mounting shell wall 102 by spring loaded hinges 138, 140. The spring loaded hinges 138, 140 bias locking shell wall 104 to the open position of FIG. 5. Biasing locking shell wall 104 to the open position quickly opens housing 101 in emergency situations thus providing convenient access to the contents of housing 101.

To prevent locking shell wall 104 from remaining open, fasteners 124, 125 found on locking shell wall 104 and mounting shell wall 102 secure housing 101 in the closed position as seen in FIG. 6. Fasteners 124, 125 may be a latch, clasp, catch, or any other known fastener that can be used to secure container 101 in a closed position such that locking shell wall 104 remains closed.

Continuing to refer to FIG. 4, support finger 106 provides a surface to mount a firearm for placement within container 101. As will be discussed below, support finger 106 extends from housing 101 to accept the barrel of a firearm. The firearm placed on support finger 106 stores the firearm arm such that the grip is oriented in an upward direction. The support finger 106 also positions the barrel of the firearm towards the floor and away from the user to prevent accidental shootings that may occur while removing the firearm from housing 101. Further, the support finger 106 provides a stable storage position for firearm. Support finger 106 does not pivot similarly to locking shell wall 104. Thus, support finger 106 of the present invention eliminates unnecessary movement of a firearm that increases the difficulty of accessing the firearm.

FIG. 5 shows a side elevational view of the present invention. Support arm 114 releasably attaches to housing 101. More particularly, support arm 114 releasably attaches to mounting shell wall 102. Support arm retention finger 126 of support arm 114 engages at least one of the housing retention fingers 116, 118, 120, 122. As seen in FIG. 5, housing retention fingers 116, 118, 120, 122 accept support arm retention finger 126 to releasably attach housing 101 to support arm 114. The present invention provides multiple housing retention fingers 116, 118, 120, 122 to enable the user to customize the height at which housing 101 releasably attaches to support arm 114. For example, FIG. 5 shows support arm 114 attached at housing retention fingers 116, 118. As the height of upper support surface increase, the user may wish to attach housing 101 at a lower position of mounting shell wall 102, thus increasing the height at which the present invention stores the firearm. Therefore, the user releasably attaches support arm finger 126 at housing retention fingers 120, 122 to raise support finger 106.

Continuing to refer to FIG. 5, support finger 106 releasably attaches to housing 101. The support finger 106 of one embodiment attaches to housing 101 such that the support finger extends substantially parallel to the major surface of the mounting shell wall 102. In one embodiment, support finger 106 includes an upper attachment element 130 and lower attachment element 134 that engage the mounting shell wall 102. Mounting shell base 142 of mounting shell wall 102 provides a steady surface for attachment of support finger 106 for improved access to the firearm stored on support finger 106. The attachment of support finger 106 to housing 101 will be discussed in greater detail below.

Fastener 124 of mounting shell wall 102 engages fastener 125 of locking shell wall 104 to close housing 101 as shown in FIG. 6. As discussed earlier, fasteners 124, 125 secure housing 101 in the closed position. Fasteners 124, 125 may be a latch, clasp, catch, or any other known fastener that can be used to secure container 101 in a closed position such that locking shell wall 104 remains closed. Because fasteners 138, 140, such as spring loaded hinges, bias locking shell wall 104 away from mounting shell wall 102, fasteners 124, 125 overcome the bias of fasteners 138, 140 to close housing 101. A user manipulates fasteners 124, 125 to release the upper portion of locking shell wall 104 from mounting shell wall 102 to pivot locking shell wall 104 to the open position.

Figure 7:
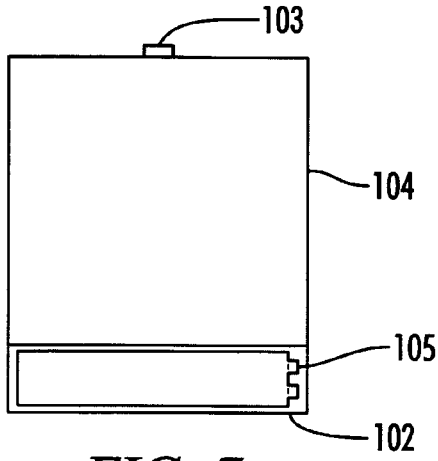
FIG. 7 is a front elevational view thereof.

Referring to FIG. 7, locking element 103 communicates with fasteners 124, 125 to open and close housing 101. A user activates locking element 103 to release fasteners 124, 125 to pivot locking shell wall 104 to the open position. In one embodiment, locking element 103 is a biometric element that accepts user input such as a fingerprint. Locking element 103 may take the form of a code entry system, a padlock, a key hole, or other known locking systems.

Power source 105 provides a mobile power source for the firearm storage device. If the present invention utilizes an electronic lock or a form of biometric lock that requires power, the preset invention includes a power source 105 attached to housing 101. The power source 105 continues to maintain the lock such that locking shell wall 104 will not pivot to the open position during transport of the housing 101.

Figure 8:
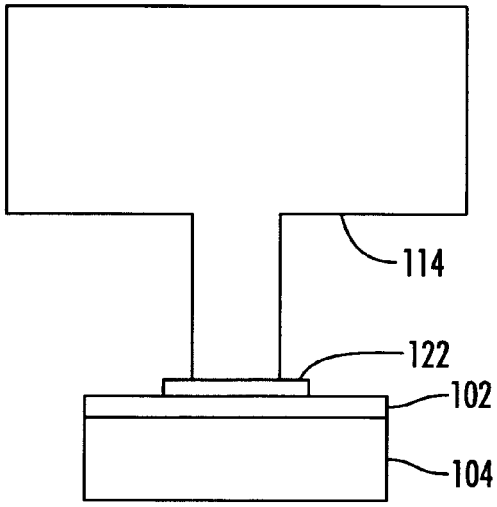
FIG. 8 is a bottom plan view thereof.
Figure 9:
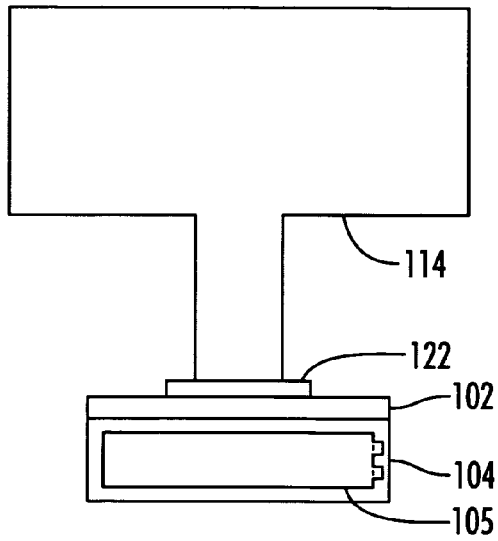
FIG. 9 is a bottom plan view of another embodiment of the present invention.

FIGS. 8 and 9 show two different embodiments of the present invention. The embodiment shown in FIG. 8 does not utilize a power source 105 externally of housing 101 whereas FIG. 9 utilizes power source 105 external of the housing 101. Power source 105 can also be stored internally of housing 101. As seen from FIG. 8, mounting shell wall 102 attaches to support arm 114.

Figure 10:
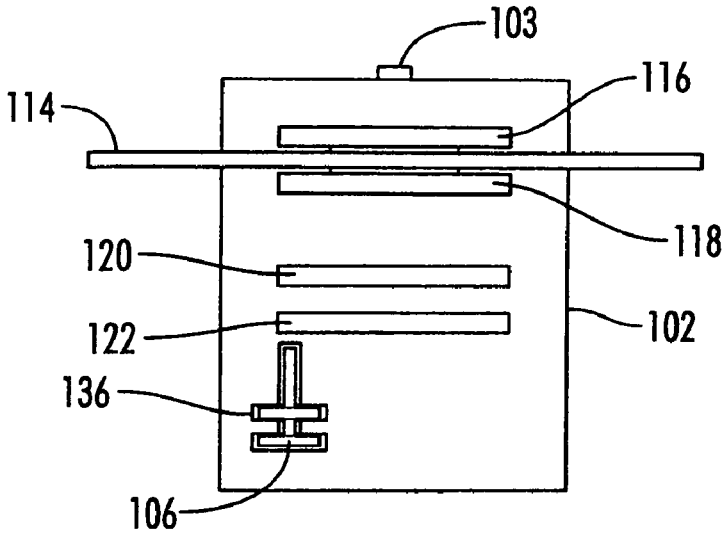
FIG. 10 is a rear elevational view of the firearm storage device of the present invention.
Figure 11:
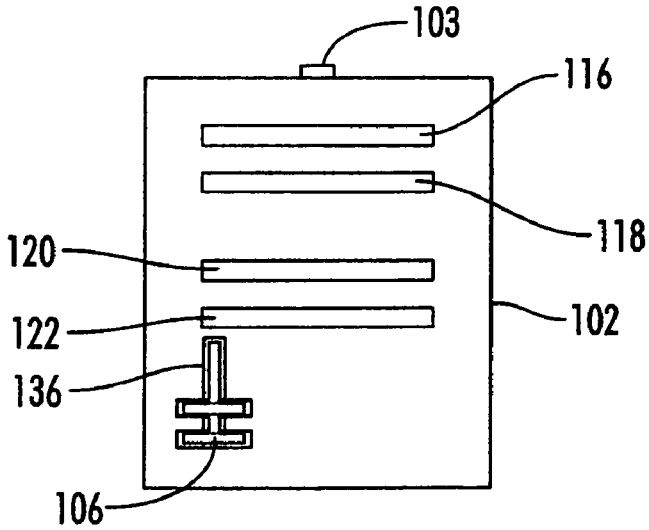
FIG. 11 is a rear elevational view of the mounting shell wall of the present invention.
Figure 12:
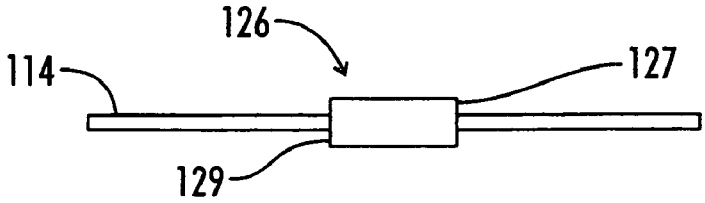
FIG. 12 is a front elevational view of the support arm of the present invention.
Figure 13:
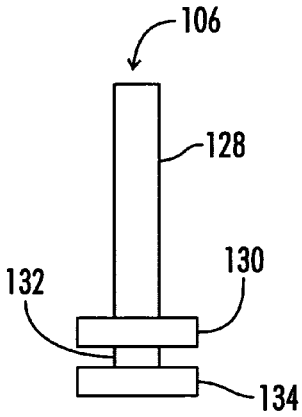
FIG. 13 is a front elevational view of the support finger of the present invention.
Figure 14:
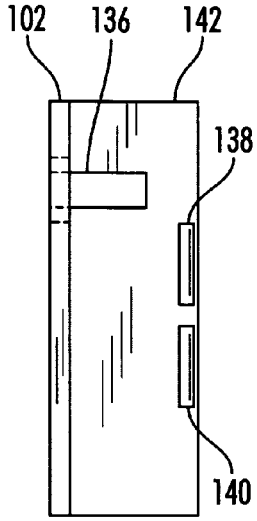
FIG. 14 is a top plan view of the mounting shell wall of the present invention.
Figure 15:
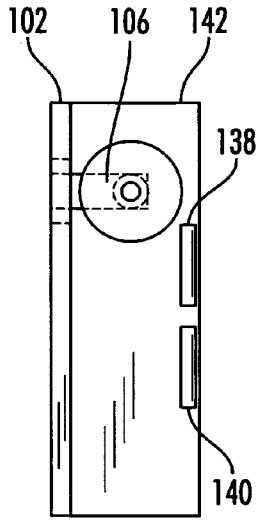
FIG. 15 is another top plan view of the mounting shell wall of the present invention.

Referring to FIG. 10, mounting shell wall 104 will be explained in greater detail. Housing retention fingers 116, 118, 120, 122 are adapted to receive the support arm retention finger 126 for attachment of support arm 114. As seen in FIG. 12, support arm retention finger 126 extends above and below support arm 114. Support arm retention finger 126 utilizes upper retention element 127 and lower retention element 129 to attach support arm 114 to mounting shell wall 102. Upper retention element 127 engages one of housing retention fingers 116, 120. Lower retention element 129 engages one of housing retention fingers 118, 122. To lower the opening of housing 101 in relation to support arm 114, a user attaches support arm retention finger 126 to housing retention elements 116, 118. To raise the opening of housing 101 in relation to support arm 114, a user attaches support arm retention finger 126 to housing retention elements 120, 122.

Figure 17:
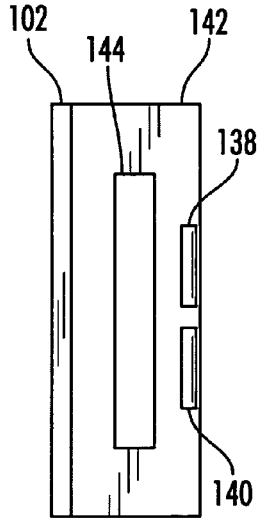
FIG. 17 is a top plan view of the mounting shell wall of one embodiment of the present invention.

Referring to FIGS. 11, 13, 14, and 15, the attachment of support finger 106 will be discussed in greater detail. Locking shell wall 104 is not shown in FIGS. 14 and 15 to show mounting shell wall base 142 of mounting shell wall 102. Support finger aperture 136 located within mounting shell wall 102 accepts support finger 106. Support finger aperture 136 extends to mounting shell wall base 142 of mounting shell wall 102. Support finger aperture 136 of mounting shell base 142 receives support finger passage element 132 such that support finger 106 is located within housing 101. Mounting shell base 142 engages support finger elements 130, 134 to releasably attach support finger 106 to housing 101. In one embodiment, mounting shell wall 102 provides at least two support finger apertures so that the firearm stored upon support finger 106 can be stored with the grip in either direction. Such customization allows the user to adjust the firearm storage device for the user's preferences. In addition, the multiple support finger apertures allow for the firearm storage device 100 to be located on either side of the bed. In another embodiment, as shown in FIG. 17, support finger 106 adjustably attaches to mounting shell base 142. The adjustable attachment of support finger 106 enables a user to customize the placement of support finger 106. In such an embodiment, a fastener can be used to prevent support finger 106 from moving after a user has positioned support finger 106 along adjustment aperture 144. To adjust the support finger 106 in the embodiment shown in FIG. 17, a user positions support finger 106 along adjustment aperture 144 of mounting shell base 142 to the desired location. The user then attaches support finger 106 at the desired location for storage of firearm 112 within housing 101.

Figure 16:
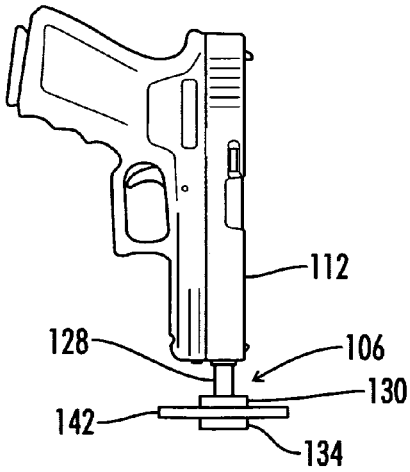
FIG. 16 is a front elevation view of the mounting shell wall of the present invention.

Referring to FIG. 16, barrel support element 128 secures firearm 112 within housing 101. Barrel support element 128 is sized to engage the barrel of firearm 112. Barrel support element 128 stores firearm 112 vertically to provide user with access to firearm 112. Because different firearms have different barrel sizes, the size of barrel support element 128 varies according to the type of firearm to be stored. Therefore, the present invention provides a releasably attachable support finger 106. Thus, a user installs support finger 106 that corresponds with the type of firearm to be stored within housing 101.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A firearm retention apparatus for storing a firearm having a barrel in an oriented direction for ease of access wherein the apparatus is supported by a lower support surface and an upper support surface, the apparatus comprising:

a support arm for placement between the lower support surface and the upper support surface;

a housing attached to said support arm, said housing configured to store at least one object wherein said housing extends horizontally away from said support arm, wherein said housing adjustably attaches to said support arm;

a support finger inside said housing, said support finger adapted to secure the object wherein the support finger extends in an upward direction from the housing;

a support arm retention finger of said support arm;

a first housing retention finger of said housing; said first housing retention finger configured to engage said support arm retention finger to adjustably attach said housing to said support arm;

a second housing retention finger of said housing; said second housing retention finger configured to engage said support arm retention finger to adjustably attach said housing to said support arm; said second housing retention finger located either above or below said first housing retention finger, said first housing retention finger adjustably attaches said housing to said support arm at a different height relative to said support arm than said second housing retention finger.

2. A firearm retention apparatus for storing a firearm having a barrel in an oriented direction for ease of access wherein the apparatus is supported by a support surface, the apparatus comprising:

a support arm for positioning a housing adjacent the support surface;

the housing attaches to said support arm, said housing configured to store the firearm;

a mounting shell wall of said housing, said mounting shell wall including a major surface which attaches to said support arm to attach said housing to said support arm;

a locking shell wall of said housing, said locking shell wall adapted to engage said mounting shell wall, said locking shell wall pivotally attached to said mounting shell wall; and a support finger inside said housing, said support finger extending in at least a substantially upward direction from the housing wherein the support finger is configured to pass into the barrel of the firearm to orient the firearm in said housing to direct the barrel of the firearm in a substantially downward direction, wherein said support finger is adjustably attached to said mounting shell wall and extends substantially parallel to said major surface to adjustably attach said support finger at one of at least two positions within said housing.

3. A firearm retention apparatus for storing a firearm having a barrel in an oriented direction for ease of access wherein the apparatus is supported by a support surface, the apparatus comprising:

a support arm for securing a housing near the support surface;

the housing attaches to said support arm, said housing stores the firearm;

a mounting shell wall of said housing, said mounting shell wall including a major surface which attaches to said support arm to attach said housing to said support arm;

a locking shell wall of said housing, said locking shell wall pivotally attached to said mounting shell wall, said locking shell wall pivots in relation to the mounting shell wall to open and close said housing;

a support finger configured to orient the firearm inside said housing, said support finger extending in at least a substantially upward direction from the housing wherein the support finger is configured to pass into the barrel of the firearm to orient the firearm in said housing in a substantially downward direction, said support finger attaches to said mounting shell wall and extends substantially parallel to said major surface to secure said support finger in a relatively fixed position during pivoting of the locking shell wall.

* * * * *